US008883711B2

(12) United States Patent
Leonard et al.

(10) Patent No.: US 8,883,711 B2
(45) Date of Patent: Nov. 11, 2014

(54) CLEANING COMPOSITION WITH IMPROVED STAIN REMOVAL

(75) Inventors: Isabelle Leonard, Lens St Servais (BE); Valerie Kochowski, Rhode-St-Genese (BE); Genevieve Bonnechere-Delstanche, Awans (BE); Olivier Henry, Nil-St-Vincent (BE)

(73) Assignee: Italmatch Chemicals SpA, Genoa (IT)

( * ) Notice: Subject to any disclaimer, the term of this patent is extended or adjusted under 35 U.S.C. 154(b) by 0 days.

(21) Appl. No.: 13/696,620

(22) PCT Filed: May 19, 2011

(86) PCT No.: PCT/EP2011/058154

§ 371 (c)(1), (2), (4) Date: Dec. 13, 2012

(87) PCT Pub. No.: WO2011/144699

PCT Pub. Date: Nov. 24, 2011

(65) Prior Publication Data

US 2013/0085094 A1 Apr. 4, 2013

(30) Foreign Application Priority Data

May 19, 2010 (EP) ..... 10163222
May 19, 2010 (NL) ..... 2004743

(51) Int. Cl.
*C11D 3/22* (2006.01)
*C11D 3/33* (2006.01)
*B08B 3/04* (2006.01)

(52) U.S. Cl.
CPC *C11D 3/33* (2013.01); *C11D 3/226* (2013.01); *C11D 3/225* (2013.01)
USPC ..... 510/470; 510/245; 510/272; 510/480; 510/490; 510/499; 134/25.2; 134/25.3; 134/39; 134/42; 8/137

(58) Field of Classification Search
CPC ..... C11D 3/22; C11D 3/33; B08B 3/04
USPC ..... 510/245, 272, 470, 480, 490, 499; 134/25.2, 25.3, 39, 42; 8/137
See application file for complete search history.

(56) References Cited

U.S. PATENT DOCUMENTS

| | | | | |
|---|---|---|---|---|
| 2008/0221006 | A1* | 9/2008 | Heisig et al. | 510/272 |
| 2009/0032058 | A1 | 2/2009 | McRae | |
| 2009/0298738 | A1* | 12/2009 | Kneipp et al. | 510/245 |

FOREIGN PATENT DOCUMENTS

| | | | |
|---|---|---|---|
| DE | 102007044417 | A1 | 3/2009 |
| EP | 0440074 | A1 | 8/1991 |
| EP | 0627490 | A1 | 12/1994 |
| EP | 1655362 | A1 | 5/2006 |
| EP | 1713831 | B1 | 4/2008 |
| WO | 91/17189 | A1 | 11/1991 |
| WO | 94/01849 | A1 | 1/1994 |
| WO | 94/12541 | A1 | 6/1994 |
| WO | 95/07303 | A1 | 3/1995 |
| WO | 95/12619 | A1 | 5/1995 |

(Continued)

*Primary Examiner* — Brian P Mruk
(74) *Attorney, Agent, or Firm* — Samuel Digirolamo; Husch Blackwell LLP

(57) ABSTRACT

The invention relates to a cleaning composition with improved stain removal. The alkaline composition contains a hydrolysable dispersing polymer which is selected from carboxylated fructans and one or more biodegradable aminocarboxylate chelating agents.

11 Claims, 2 Drawing Sheets

(56) References Cited

FOREIGN PATENT DOCUMENTS

| | | | |
|---|---|---|---|
| WO | 95/15984 | A1 | 6/1995 |
| WO | 96/34017 | A1 | 10/1996 |
| WO | 2006/029806 | A1 | 3/2006 |
| WO | 2008/132133 | A1 | 11/2008 |
| WO | 2009/020546 | A1 | 12/2009 |

* cited by examiner

CLEANING COMPOSITION WITH IMPROVED STAIN REMOVAL

CROSS REFERENCE TO RELATED APPLICATIONS this Application is a U.S. National Phase Patent application of international Application PCT/EP2011/058154, filed 19 May 2011, which claims the benefit of priority from European Patent Application No. 10163222.2 filed on 19 May 2010 and Netherlands Patent Application No. 2004743 filed 19 May 2010. The disclosures of International Application PCT Application No. PCT/EP2011/058154, European Patent Application No. 10163222.2 and Netherlands Patent Application No. 2004743 are incorporated herein by reference.

TECHNICAL FIELD

The present invention relates generally to the field of cleaning compositions. In particular, the present invention relates to a cleaning composition suitable for stain removal. The present invention also relates to the use of the cleaning composition in domestic and/or institutional and industrial surfaces cleaning.

DESCRIPTION OF RELATED ART

Traditional cleaners used for cleaning surfaces in the industrial and institutional area such as car washes, auto dishwashing, laundry detergent, CIP cleaners, are based on the use of alkaline cleaners that contain chelating agents such as nitrilotriacetic acid (NTA), ethylenediaminetetraacetic acid (EDTA) and phosphonates to control water hardness ions. NTA is by far the most widely used in these applications. Chelating agents are used to control water hardness ions such as $Ca^{2+}$ and $Mg^{2+}$ providing scale inhibition formation in hard water by keeping these ions in solution. Chelating agents further provide control of other bivalent and trivalent ions such as manganese, copper and iron ions. This is of primary importance when cleaning compositions contain oxygen bleaches. Indeed, these ions act as catalysts for the decomposition of such bleach. The addition of efficient metal ion chelating agents provides bleach stabilization.

Cleaning compositions sometimes also contain polycarboxylic polymers that provide soil dispersion. This further increases the cleaning performance by keeping the soil in solution. Soil is then easily rinsed away. The most widely used polymers in such application are polyacrylate homo polymers of relatively low molecular weights and/or polyacrylate co-polymers of higher molecular weights.

Recent regulatory changes on NTA (classification as carcinogenic ingredient) as well as the need to convert cleaning compositions to safer and more environmentally friendly formulation is forcing the formulators to find alternatives to conventional chelating agent such as NTA and EDTA. Different alternatives can be found on the market but the simple substitution strategy does not give satisfactory results in terms of stain removal.

WO 2008/132133 discloses a phosphate-free dishwasher detergent containing 0.01-20% by weight of at least one specific alcohol alkoxylate, 0.01-10% by weight of at least one specific alcohol ethoxylate, 0-15% by weight of at least one sulfonate group-containing polymer, 0-15% by weight of at least one hydrophilically modified polycarboxylate, 0-8% by weight of at least one polycarboxylate, 1-50% by weight of at least one complexing agent and 0.1-60% by weight of at least one further additive, components (A), (B), (C), (D), (E), (F) and (G) adding up to 100%.

WO 2006/029806 discloses a phosphate-free cleaning formulation for a dish cleaning machine containing the following components: (a) 1-20% by weight hydrophobically modified polycarboxylate, (b) 1-50% by weight complexing agent, (c) 1-15% by weight non-ionic low-foaming detergents, (d) 0.1-30% by weight bleaching and optionally a bleaching activator, (e) 0-60% by weight additional detergents, (f) 0-8% by weight enzymes, (g) 0-50% by weight one or several types of additives, wherein from (a) to (g) is equal to 100% by weight.

US 2008/0221006 discloses an alkaline cleaning composition comprising a source of alkalinity, a biodegradable surfactant system and a biodegradable chelating agent. The influence of the biodegradable agent on antimicrobial activity is negligible at room or elevated temperature.

EP-A 1 655 362 discloses compositions comprising water-soluble polymeric polycarboxylates. Said compositions may include complexing agents and alkalizers. Said alkalizers are used in an amount of 2 wt % to 8 wt %. EP-A 2 045 317 discloses compositions comprising calcium-binding enzyme and complexing agents.

WO 2009/020546 discloses an aqueous, concentrated neutral detergent composition for use in cleaning medical instruments and metal components having scale control and corrosion inhibition properties. The composition comprises at least one surfactant, at least one scale control component, at least one corrosion inhibitor, a buffer system and water.

Cleaning compositions known in the art have several disadvantages such as the low efficiency in stain removal, toxicity or low biodegradable properties. There is thus a need for an effective cleaning composition suitable for domestic and/or industrial and institutional surface cleaning. In short, there is a need for effective cleaning composition for surface cleaning which have enhanced cleaning performance to currently available products, are biodegradable, non-toxic, non-carcinogenic or cost effective.

The present invention aims at providing cleaning compositions that overcome the above-discussed drawbacks of the prior art. In particular, the present invention aims at providing cleaning compositions which are environmentally friendly and exhibit enhanced stain removal.

SUMMARY OF THE INVENTION

It is an advantage of the invention to provide cleaning compositions with enhanced stain removal comprising one or more biodegradable aminocarboxylate chelating agents and a hydrolysable dispersing polymer. It is another advantage of the present invention to provide cleaning compositions wherein the biodegradable aminocarboxylate chelating agent and the hydrolysable dispersing polymer are environmentally friendly. It is another advantage of the present invention to provide a cleaning composition exhibiting synergism between the biodegradable aminocarboxylate chelating agent and the hydrolysable dispersing polymer. It is another advantage of the present invention to provide cleaning compositions with a hydrolysable dispersing polymer. It is another advantage of the present invention to provide cleaning compositions with low toxicity.

According to a first aspect, the invention provides a cleaning composition characterized in that the cleaning composition comprises:

(I) a hydrolysable dispersing polymer, and (II) one or more biodegradable aminocarboxylate chelating agents.

In particular, said cleaning composition is an alkaline composition.

The composition of the present invention may optionally further contain a component (III) comprising any one, or combination of, conventional ingredients well known in the art of cleaning compositions.

The term "hydrolysable" as used herein means that the backbone of the polymer is susceptible to hydrolysis, i.e. that the polymer comprises a polycondensate containing ether, ester and/or amide bonds. The term "dispersing" as used herein means that the polymer is capable of dispersing soil particles in the aqueous cleaning medium. The term "biodegradable" as used herein means that the amino carboxylate chelating agent can be degraded by micro-organisms, preferably that it is readily biodegradable in accordance with either of OECD Guideline for Testing of Chemicals 301 methods A to F. The term "chelating agent" as used herein means that the compound is able to bind a single positively charged central atom, preferably a metal cation such as $Ca^{2+}$ or $Mg^{2+}$.

The cleaning composition of the present invention enhances stain removal due to the synergistic and specific combination of a dispersing polymer and one or more chelating agents. Another advantage of the cleaning composition is that the aqueous cleaning composition may be free of various phosphorous compounds, such as phosphonates, phosphates, polyphosphates and the like. As mentioned above cleaning compositions of the present invention surprisingly yield synergistic results with regard to cleaning performance. Unexpected results with respect to soil removal are obtained.

According to a second aspect, the use of the cleaning composition according to the present invention for stain removal is provided. According to a further aspect of the invention there is provided a method for cleaning a surface comprising the step of contacting the surface with a composition of the invention.

DETAILED DESCRIPTION OF THE INVENTION

Figure 1A:
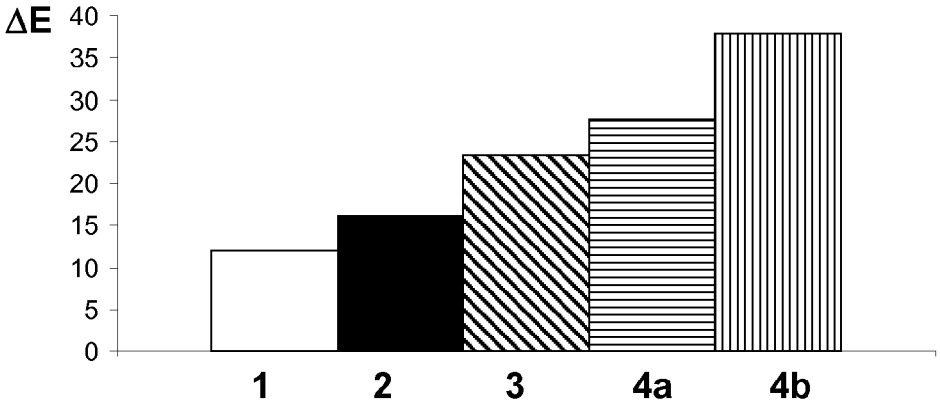
FIG. 1A and FIG. 1B are comparative charts representing stain removal (ΔE) obtained in presence of various compositions on starch mix and coffee stains respectively. These figures illustrate the synergy observed between one hydrolysable dispersing polymer (carboxymethylinulin) and one biodegradable aminocarboxylate chelating agent (methylglycin diacetic acid—MGDA).

According to a first aspect, the invention provides a cleaning composition characterized in that the composition is an alkaline composition and comprises:

(I) a hydrolysable dispersing polymer, and (II) one or more biodegradable aminocarboxylate chelating agents.

Preferably, the cleaning composition is an aqueous alkaline composition. The pH of the cleaning composition may be higher than 9, preferably higher than 11. The cleaning compositions of the present invention may be used at temperature ranging from 20° C. to 95° C., preferably from 40° C. to 90° C.

The alkalinity of the composition may be controlled by adding alkaline component to the composition. Said alkaline component may be alkaline hydroxide, alkaline carbonate, alkaline-earths hydroxide, alkaline-earths carbonate or mixtures thereof. Non limitative examples of alkaline component are NaOH, KOH, $Na_2CO_3$, $K_2CO_3$, LiOH, $Li_2CO_3$, $Mg(OH)_2$, $Ca(OH)_2$, $MgCO_3$, $CaCO_3$. The amount of alkaline component in the present composition may range from 10 wt % to 85%, preferably from 10 wt % to 75 wt %.

While the percentages for components of the aqueous, cleaning composition as described herein are considered optimal, some variation in the range is permitted. It should be noted that these wider ranges for individual components of the inventive composition contemplate that the composition will be prepared as a concentrate with further dilution as necessary as required. Both the concentrated and diluted form are within the scope of the invention.

The number of biodegradable aminocarboxylate chelating agents within the cleaning composition may range from 1 to 10, preferably from 1 to 5. More preferably, the cleaning composition comprises one biodegradable aminocarboxylate chelating agent. Alternatively, the cleaning composition may comprise two biodegradable aminocarboxylate chelating agents.

The term "substituted" as used in the present invention means that one or more hydrogen of the corresponding atom is replaced with a selection of substituents, provided that the valence of said corresponding atom does not exceed the normal valence thereof, and that the substitution gives rise to a chemically stable compound, i.e. a robust compound able to survive to its identification at an acceptable degree of purity from the reaction mixture.

When indicating the number of substituents, the term "one or more" means from one substituent to the highest possible number of substitution, i.e. replacement of one hydrogen up to replacement of all hydrogen by substituents.

The term "$C_1$-$C_{10}$ linear, branched, cyclic hydrocarbon radical" as used herein refers to a hydrocarbyl radical having from 1 to 10 carbon atoms. For example, the hydrocarbon radical refers to, but is not limited to, the radicals methyl, ethyl, n-propyl, i-propyl, n-butyl, i-butyl, s-butyl, t-butyl, 1-pentyl, 2-pentyl, 3-pentyl, i-pentyl, neo-pentyl, t-pentyl, 1-hexyl, 2-hexyl, 3-hexyl, 1-methyl-1-ethyl-n-pentyl, 1,1,2-tri-methyl-n-propyl, 1,2,2-trimethyl-npropyl, 3,3-dimethyl-n-butyl, 1-heptyl, 2-heptyl, 1-ethyl-1,2-dimethyl-n-propyl, 1-ethyl-2,2-dimethyl-n-propyl, 1-octyl, 3-octyl, 4-methyl-3-n-heptyl, 6-methyl-2-n-heptyl, 2-propyl-1-n-heptyl, 2,4,4-trimethyl-1-n-pentyl, 1-nonyl, 2-nonyl, 2,6-dimethyl-4-n-heptyl, 3-ethyl-2,2-dimethyl-3-n-pentyl, 3,5,5-trimethyl-1-n-hexyl, 1-decyl, 2-decyl, 4-decyl, 3,7-dimethyl-1-n-octyl, 3,7-dimethyl-3-n-octyl. The hydrocarbon radical may be substituted. For example, the term "$C_{1-6}$ hydrocarbon radical" refers to a hydrocarbon radical having from 1 to 6 carbon atoms and includes but is not limited to, methyl, ethyl, n-propyl, i-propyl, n-butyl, i-butyl, s-butyl, t-butyl, 1-pentyl, 2-pentyl, 3-pentyl, i-pentyl, neo-pentyl, t-pentyl, 1-hexyl, 2-hexyl, 3-hexyl. For example, the term "$C_{1-3}$ hydrocarbon radical" denotes a hydrocarbon radical having from 1 to 3 carbon atoms and refers to, but is not limited to, methyl, ethyl, n-propyl, i-propyl.

The term "heterocyclic" refers to a heterocycloalkyl or a heteroaryl radical. The term "heterocycloalkyl" refers to a monovalent saturated or partially unsaturated monocyclic ring system. Preferably, the heterocycloalkyl may be 5- or 6-membered heterocycloalkyl, i.e. a monovalent monocyclic ring containing one or two ring heteroatoms selected from N, O, and S. Examples for 5- or 6-membered heterocycloalkyl moieties are tetrahydropyranyl, tetrahydrothiopyranyl, tetrahydrofuranyl, tetrahydrothiophenyl, pyrrolidinyl, imidazolidinyl, morpholinyl, thiomorpholinyl, piperidinyl, and piperazinyl. Preferred examples are morpholinyl, piperidinyl or piperazinyl. The term "heteroaryl" as defined herein denotes a monovalent monocyclic or bicyclic, preferably monocyclic, aromatic ring system of 5 or 6 ring atoms containing one, two, or three ring heteroatoms selected from N, O, and S, the remaining ring atoms being carbon atoms. Examples of heteroaryl moieties include, but are not limited to thiophenyl, furanyl, pyrrolyl, imidazolyl, pyrazolyl, oxazolyl, isoxazolyl, thiazolyl, isothiazolyl, [1,2,4]oxadiazolyl, [1,3,4]oxadiazolyl, [1,2,4]triazolyl, [1,2,3]triazolyl, tetrazolyl, pyridinyl, pyrimidinyl, pyrazinyl or pyridazinyl.

The term "aromatic groups" as used herein refers to polyunsaturated groups having one or more fused rings or covalently linked, containing from 6 to 10 carbon atoms, wherein the ring is aromatic. The aromatic group can be substituted. For example, the aromatic group can be phenyl or naphtyl.

In a preferred embodiment, in the cleaning composition according to the present invention said one or more biodegradable aminocarboxylate chelating agents (II) is of general formula (A), or salt thereof:

(A)

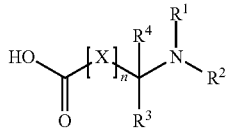

wherein $R^1$ and $R^2$ are independently selected from the group consisting of hydrogen, $C_1$-$C_{10}$ linear, branched or cyclic hydrocarbon radicals bearing one or more carboxylic acid groups and salts thereof, $R^3$ and $R^4$ are independently selected from the group consisting of hydrogen, COOH and $C_1$-$C_{10}$ linear, branched, cyclic or aromatic hydrocarbon radicals, which radicals are unsubstituted or substituted by one or more substituents, said substituents are selected from the group consisting of OH, COOH, COOR', F, Br, Cl, I, OR', $SO_3H$, $SO_3R'$, SH, SR', $NH_2$, $NR'_2$, $CONH_2$, $CONR'_2$, $C_5$-$C_6$ heterocyclic groups, $C_1$-$C_{10}$ linear, branched, cyclic or aromatic groups unsubstituted or substituted by one or more OH, COOH, COOR', F, Br, Cl, I, OR', $SO_3H$, $SO_3R'$, SH and/or SR' moieties wherein R' is a $C_1$-$C_{10}$ linear, branched, cyclic or aromatic hydrocarbon group, n is an integer from 0 to 10, and X is a substituted or unsubstituted methylene group.

Preferably, the aminocarboxylate chelating agents (II) of general formula (A) may not be a compound wherein the substituents $R^1$ and $R^2$ are simultaneously hydrogen.

The term "methylene group" refers to a hydrocarbyl radical having one carbon atom. The methylene group may be unsubstituted and may be a —$CH_2$-moiety. Alternatively, the methylene group may be substituted by one or two substituents selected from the group consisting of OH, COOH, COOR', F, Br, Cl, I, OR', $SO_3H$, $SO_3R'$, SH, SR', $NH_2$, $NR'_2$, $CONH_2$, $CONR'_2$, $C_5$-$C_6$ heterocyclic groups and $C_1$-$C_{10}$ linear, branched, cyclic or aromatic groups unsubstituted or substituted by one or more OH, COOH, COOR', F, Br, Cl, I, OR', $SO_3H$, $SO_3R'$, SH and/or SR' moieties wherein R' is a $C_1$-$C_{10}$ linear, branched, cyclic or aromatic hydrocarbon group.

In a preferred embodiment, said one or more biodegradable aminocarboxylate chelating agents (II) are of general formula (A), or a salt thereof:

(A)

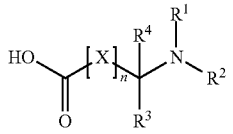

wherein $R^1$ and $R^2$ are independently selected from the group consisting of hydrogen, $C_1$-$C_3$ linear, branched or cyclic hydrocarbon radicals bearing one or more carboxylic acid groups and salts thereof, $R^3$ and $R^4$ are independently selected from the group consisting of hydrogen, COOH and $C_1$-$C_{10}$ linear, branched, cyclic or aromatic hydrocarbon radicals, which radicals are unsubstituted or substituted by one or more substituents, said substituents are selected from the group consisting of OH, COOH, COOR', F, Br, Cl, I, OR', $SO_3H$, $SO_3R'$, SH, SR', $NH_2$, $NR'_2$, $CONH_2$, $CONR'_2$, $C_5$-$C_6$ heterocyclic groups and $C_1$-$C_{10}$ linear, branched, cyclic or aromatic groups unsubstituted or substituted by one or more OH, COOH, COOR', F, Br, Cl, I, OR', $SO_3H$, $SO_3R'$, SH and/or SR' moieties wherein R' is a $C_1$-$C_{10}$ linear, branched, cyclic or aromatic hydrocarbon group, n is an integer from 0 to 10, and X is a substituted or unsubstituted methylene group.

In a more preferred embodiment, said one or more biodegradable aminocarboxylate chelating agents (II) is of general formula (A), or a salt thereof:

(A)

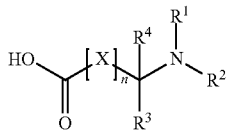

wherein $R^1$ and $R^2$ are independently selected from the group consisting of hydrogen, $C_1$-$C_3$ linear, branched or cyclic hydrocarbon radicals bearing one or more carboxylic acid groups and salts thereof, $R^3$ and $R^4$ are independently selected from the group consisting of hydrogen, COOH and $C_1$-$C_6$ linear, branched, cyclic or aromatic hydrocarbon radicals, which radicals are unsubstituted or substituted by one or more substituents, said substituents are selected from the group consisting of OH, COOH, COOR', F, Br, Cl, I, OR', $SO_3H$, $SO_3R'$, SH, SR', $NH_2$, $NR'_2$, $CONH_2$, $CONR'_2$, $C_5$-$C_6$ heterocyclic groups and $C_1$-$C_6$ linear, branched, cyclic or aromatic groups, unsubstituted or substituted by one or more OH, COOH, COOR', F, Br, Cl, I, OR', $SO_3H$, $SO_3R'$, SH and/or SR' moieties wherein R' is a $C_1$-$C_6$ linear, branched, cyclic or aromatic hydrocarbon group, n is an integer from 0 to 4, and X is a substituted or unsubstituted methylene group.

In a particularly preferred embodiment, said one or more biodegradable aminocarboxylate chelating agents (II) is of general formula (A), or a salt thereof:

(A)

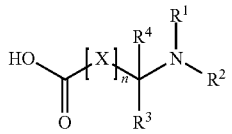

wherein $R^1$ and $R^2$ are independently selected from the group consisting of hydrogen, $C_1$-$C_3$ linear, branched or cyclic hydrocarbon radicals bearing one or more carboxylic acid groups and salts thereof, $R^3$ and $R^4$ are independently selected from the group consisting of hydrogen, COOH and $C_1$-$C_3$ linear, branched, cyclic or aromatic hydrocarbon radicals, which radicals are unsubstituted or substituted by one or more substituents, said substituents are selected from the group consisting of OH, COOH, COOR', F, Br, Cl, I, OR', $SO_3H$, $SO_3R'$, SH, SR', $NH_2$, $NR'_2$, $CONH_2$, $CONR'_2$, $C_5$-$C_6$ heterocyclic groups and $C_1$-$C_6$ linear, branched, cyclic or aromatic groups unsubstituted or substituted by one or more OH, COOH, COOR', F, Br, Cl, I, OR', $SO_3H$, $SO_3R'$, SH and/or SR' moieties wherein R' is a $C_1$-$C_3$ linear, branched, cyclic or aromatic hydrocarbon group, n is an integer from 0 to 2, and X is a substituted or unsubstituted methylene group.

In a preferred embodiment, said one or more biodegradable aminocarboxylate chelating agents have at least two carboxylic acid substituents on carbon atom(s) in alpha-position or in beta-position of the nitrogen atom. Preferably, said one or more biodegradable aminocarboxylate chelating agents have at least two carboxylic acid substituents on carbon atom(s) in alpha-position of the nitrogen atom.

In a preferred embodiment, said one or more biodegradable aminocarboxylate chelating agents (II) are selected from the group consisting of methylglycin diacetic acid (MGDA), glutamic diacetic acid (GLDA), iminodisuccinic acid (IDS), salts thereof, and mixtures thereof.

The biodegradable aminocarboxylate chelating agent (II) may be in form of a salt. Preferably, the salt is an alkali, ammonia and amine salt, especially sodium or potassium salt. When the chelating agent has more than one carboxylic acid moiety, the one or more carboxylic acid moieties can be in form of a salt.

The cleaning composition of the present invention comprises a hydrolysable dispersing polymer (I) which is preferably selected from the group consisting of carboxylated fructan components, polyaspartic acid, salts thereof, chitosan, block copolymers having polyacrylic acid moiety and chitosan and/or polysaccharide moiety(ies). In particular, the cleaning composition of the present invention comprises a hydrolysable dispersing polymer (I) which is a carboxylated fructan component.

Preferably, the cleaning composition of the present invention comprises a hydrolysable dispersing polymer (I) which is carboxylated fructan component selected from the group consisting of:

a) carboxyalkylfructan having from 1 to 4 carbon atoms in the alkyl moiety, b) dicarboxyfructan having a degree of oxidation (DO) of from 10 to 100% expressed as a molar percentage of monosaccharide units converted into the corresponding dicarboxy analogues, c) 6-carboxyfructan, d) fructan polycarboxylic acid, having a degree of carboxyalkylation or carboxyacylation of from 0.2 to 3.0, and e) mixtures thereof.

Alternatively, said hydrolysable dispersing polymer (I) may be polyaspartic acid.

Fructans used as starting material for producing the carboxylated fructans used as component (I) are oligo- and polysaccharides which have a majority of anhydrofructose units, and can have a polydisperse chain length distribution and can be of straight- or branched-chain. Preferably the fructan contains mainly beta-2,1 bonds, as in inulin. The fructans, and the preferred inulin, used as starting material for producing component (I) can be products obtained directly from a vegetable source or other sources as well as products in which the average chain length has been modified, increased or reduced, by fractionation, enzymatic synthesis or hydrolysis.

Carboxylated fructans with modified average chain length, and suitable for use as component (I) in accordance with the inventive technology, can be made from fructans with enzymatically increased chain length, fructan hydrolysis products having shortened chains and fractionated products having a modified chain length. Fractionating of fructans such as inulin can be achieved, for example, by means of known techniques including low temperature crystallization (see WO 94/01849), column chromatography (see WO 94/12541), membrane filtration (see EP-A-0440074, EP-A-0627490) or selective precipitation with alcohol. Hydrolysis to yield shorter fructans can be carried out, for example, enzymatically (endo-insulase), chemically (water and acid) or by heterogeneous catalysis (acid column). Reduced, oxidized, hydroxyalkylated and/or crosslinked fructans can also represent suitable starting materials to produce the carboxylated fructans used as component (I). The fructans have an average chain length (degree of polymerization, DP) of at least 3 to about 1000. Preferably, the average chain length is from 3 to 60, in particular of from 5 to 30 monosaccharide units. A preferred fructan is inulin (beta-2,1-fructan) or a modified inulin, and these preferred carboxylated inulins and modified inulins are made accordingly.

Dicarboxyfructans can be obtained through oxidation of the fructan raw material, and accordingly the preferred dicarboxyinulins can be obtained through oxidation of the inulin raw material. The anhydrofructose units are converted, with ring opening, into dicarboxy(hydroxyethoxy)ethyleneoxy units. The oxidation can proceed in one step with hypohalite, as described in WO 91/17189, or in two steps with periodate and chlorite, as described in WO 95/12619. Preferred degrees of oxidation (DO) are in the range of from 20 to 90%, the DO being the (molar) percentage of monosaccharide units converted into the corresponding dicarboxy analogues.

Fructan polycarboxylic acid is preferably inulin polycarboxylic acid which can be prepared by successive oxidation and carboxyalkylation of the selected starting material. The material has a DO (degree of oxidation) of from 0.2 to 2.0 and a degree of carboxy-alkyl/-acyl substitution of from 0.2 to 3, preferably from 1.5 to 2.7.

6-carboxyfructan is preferably 6-Carboxy inulin, which is a well known material. It can be obtained by oxidation in accordance with the method of WO 95/07303.

The term "polyaspartic acid" refers to a homo or co-polymer having at least one block comprising repetitive unit of aspartic acid. Polyaspartic acid may be in form of a salt. The term encompasses polymer from both L and D-aspartic acid monomer.

The term "chitosan" refers to a linear polysaccharide composed of randomly distributed β-(1-4)-linked D-glucosamine. The term "chitosan" encompasses chitosan wherein part or whole amine moities are substituted.

In preferred embodiment, the carboxylated fructan component is selected from carboxyalkylinulin having 1 or 2 carbon atoms in the alkyl moiety (e.g. carboxymethylinulin and/or carboxyethylinulin) and having a degree of substitution of from 1.5 to 2.7. Carboxymethylinulin can be prepared by reaction of the fructan with chloroacetic acid as described in WO 95/15984 or in EP 1 713 831. Carboxylethylinulin can be prepared in accordance with the method of WO 96/34017.

Hence, in a preferred embodiment, the dispersing polymer (I) is selected from the group consisting of carboxyalkylinulin having 1 or 2 carbon atoms in the alkyl moiety and having a degree of substitution of from 1.5 to 2.7.

In a preferred embodiment, the carboxylated fructan component is carboxymethylinulin having a degree of substitution of from 1.5 to 2.7. More preferably, the hydrolysable dispersing polymer (I) is carboxymethylinulin having a degree of substitution of from 1.5 to 2.7. Alternatively, more preferably, the hydrolysable dispersing polymer (I) is polyaspartic acid or a salt thereof.

The weight ratio between components (I) and (II) may be in the range of 30:1 to 1:100. Preferably the weight ratio between components (I) and (II) is in the range of 1:1 to 1:100.

In a preferred embodiment, the percentage in active ingredient of biodegradable aminocarboxylate chelating agents (II), in the cleaning composition, is in the range from 0.5 to 50%. Preferably, the percentage in active ingredient of biodegradable aminocarboxylate chelating agents is in the range from 2% to 30%.

In a preferred embodiment, the percentage in active ingredient of dispersing polymer, in the cleaning composition, is in the range from 0.15% to about 5%. Preferably, the percentage in active ingredient of dispersing polymer (I) is in the range from 0.3% to 2%.

According to a second aspect, the cleaning composition of the present invention is used for stain removal. The cleaning composition according to the invention may be used in institutional and industrial surfaces cleaning. The cleaning composition according to the invention may be used in domestic surfaces cleaning. The term "industrial applications" comprises any cleaning application made in the industry, including without limitation the cleaning and washing of vehicles, walls, floors, tiles and the like, stainless steel surfaces, toilets, machines including, for example, storage tanks, tubes and pipelines, as used in the industry, subjects in processing and production facilities, such as used in the food processing industry, canteen kitchens, or slaughter houses. The term "institutional applications" comprises any cleaning application made outside industry, including without limitation the cleaning and washing of subjects in housekeeping, hotels, hospitals, airports and the like, such as cleaning and washing of walls, floors, tiles and the like, stainless steel surfaces, toilets, plates and dishes, silverware, pots and pans, china and crystalware. The term "domestic hard surfaces cleaning" comprises any cleaning application outside industry that is executed by a non-professional housekeeper (such as housewife, etc.). The cleaning method of the invention may be applied in all such uses.

Cleaning compositions of the present invention optionally furthermore contain ingredients and auxiliaries of a component (III) comprising any one, or combinations of, detergent ingredients selected from builders, solvents, perfumes, optical brighteners, other dispersing agents, pH adjusting agents, fiber softeners, suds regulants, dyes, dye transfer inhibitors, enzymes and anti-redeposition agents and additional detergent components well known in the art. Any of such components is used for its known functionality in known levels. The choice of any such component will, of course, vary depending upon the physical state, pH and application properties of a given composition. Preferably, component (III), and, thus, the composition of the invention, does not contain NTA and/or EDTA, more preferably neither NTA nor EDTA.

In a further preferred embodiment the composition of the invention is free of phosphorous compounds, such as phosphonates, phosphates, polyphosphates and the like. In a particularly preferred embodiment the composition of the invention is free of phosphorous compounds, NTA and EDTA.

EXAMPLE

Stain Removal Test

The test principle is the following: the standardized colored soiled melamine tiles are soaked, under constant and defined agitation, in beaker containing the cleaning composition to be evaluated at 2 g/L. The beaker (containing the soiled tile and the cleaning composition) is placed into an oven equipped with agitating plate. The temperature is kept constant. The percentage of active ingredient mentions in the following examples is the percentage calculated in the cleaning composition before dilution at 2 g/L.

All results detailed below were obtained in the following conditions: water hardness (40° fH), initial temperature (95° C.), oven temperature (60° C.), contact time (20 minutes), and under stirring at 100 rpm. Stain removal (ΔE) were determined by means of an optical measuring device (spectroguide 45/0 gloss from BYK Additives & Instruments). The stain removal (ΔE) was known calculation method based on color difference meter readings which is used for colored stains and colored fabrics. The formula is the following:

$$\Delta E=[(L_{\text{washed}}-L_{\text{stained}})^2+(a_{L\,\text{washed}}-a_{L\,\text{stained}})^2+(b_{L\,\text{washed}}-b_{L\,\text{stained}})^2]^{1/2}$$

wherein L represents brightness a represents+red (positive value)/−green (negative value)

b represents+yellow (positive value)/−blue (negative value).

In the following examples, the standard deviation of stain removal (ΔE) was 1.2.

In examples detailed below, methylglycin diacetic acid (MGDA) was purchased by BASF (Trilon® M series), glutamic diacetic acid (GLDA) by Akzo Nobel (Dissolvine® GL serie). Carboxymethylinulin was provided by Dequest AG (Dequest® PB serie) and polyacrylic acid polymer by Rohm&Haas (Acusol® 445N). Examples 1 to 4 were performed under institutional and industrial conditions.

Example 1

Figure 1B:
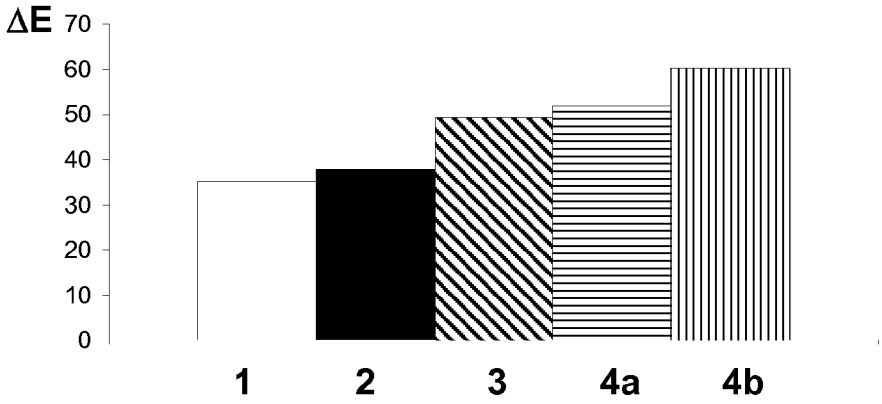

Various compositions were tested on starch mix and coffee stains. Stain removal (ΔE) are listed in Table 1. The results are represented in FIG. 1A for tests on starch mix and in FIG. 1B for coffee stains. Composition 1 contained 10% of sodium hydroxide (NaOH) solution. Composition 2 contained 10% of sodium hydroxide (NaOH) solution and 3.3% of carboxymethylinulin having a degree of substitution (DS) of 2.5. Composition 3 contained 10% of sodium hydroxide (NaOH) solution and 75% of methylglycin diacetic acid (MGDA).

Composition 4 was a composition of the present invention and contained 10% of sodium hydroxide (NaOH) solution, 3.3% of carboxymethylinulin (DS of 2.5), and 75% of methylglycin diacetic acid (MGDA). All compositions were completed with water to reach 100%. With regard to the sodium hydroxide (NaOH) solution, the percentage in active ingredient was 5%. With regard to the biodegradable aminocarboxylate chelating agent (MGDA), the percentage in active ingredient was 30%. With regard to the hydrolysable dispersing polymer (carboxymethylinulin), the percentage in active ingredient was 0.5%.

Stain removal (ΔE) expected for the composition 4 (noted 4a in FIG. 1A and FIG. 1B) was calculated by adding to stain removal value of composition 3 the difference between stain removal value of composition 2 and stain removal value of composition 1. The stain removal (ΔE) experimentally obtained with the composition 4 according to the present invention is noted 4b in FIGS. 1A and 1B.

TABLE 1

| | Comp. 1 | Comp. 2 | Comp. 3 | Comp. 4 (Expected value) | Comp. 4 (Obtained value) |
|---|---|---|---|---|---|
| Starch mix | 11.9 | 16.1 | 23.4 | 27.6 | 37.8 |
| Coffee | 35.1 | 37.9 | 49.1 | 51.9 | 60.3 |

With regard to starch mix stains, stain removal (ΔE) obtained with the composition 4 of the present invention was 37.8 which was far from the expected value (27.6). Therefore, a synergic effect was observed when combining a hydrolysable dispersing polymer, such as carboxymethyl inulin, and an biodegradable aminocarboxylate chelating agent, such as methylglycine diacetic acid. A synergism was also observed on coffee stains. Stain removal (ΔE) obtained (60.3) was surprisingly higher than the expected value (51.9).

Example 2

Figure 2A:
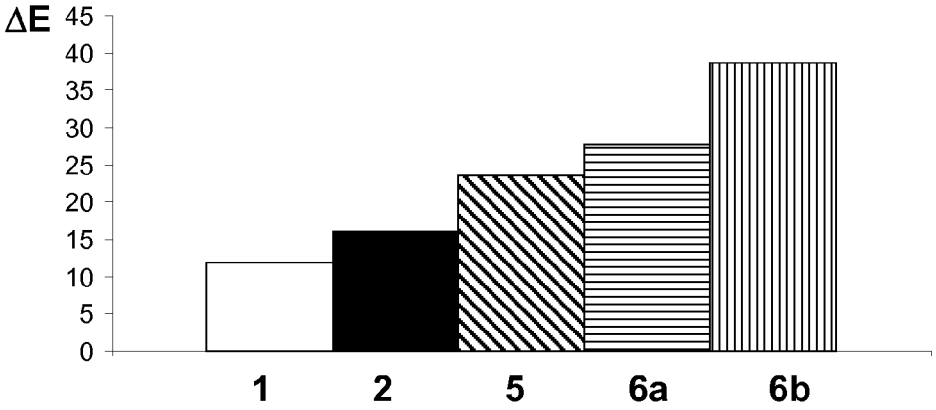
FIG. 2A and FIG. 2B are comparative charts representing stain removal (ΔE) obtained in presence of various compositions on starch mix and coffee stains respectively. These figures illustrate the synergy observed between one hydrolysable dispersing polymer (carboxymethylinulin) and one biodegradable aminocarboxylate chelating agent (glutamic diacetic acid—GLDA).
Figure 2B:
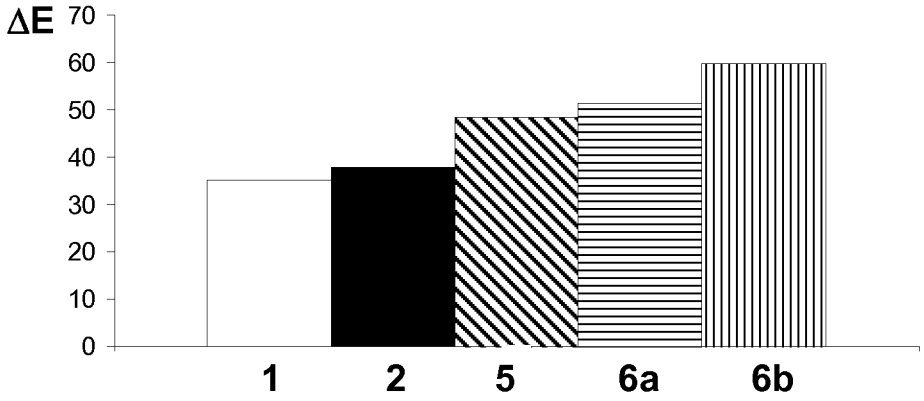

Other compositions were tested on starch mix and coffee stains. Stain removal (ΔE) are listed in Table 2. The results are represented in FIG. 2A for tests on starch mix and FIG. 2B for tests on coffee. Composition 1 contained 10% of sodium hydroxide (NaOH) solution. Composition 2 contained 10% of sodium hydroxide (NaOH) solution and 3.3% of carboxymethylinulin having a degree of substitution (DS) of 2.5. Composition 5 contained 10% of sodium hydroxide (NaOH) solution and 75% of glutamic diacetic acid (GLDA). Composition 6 was a composition of the present invention and contained 10% of sodium hydroxide (NaOH) solution, 3.3% of carboxymethylinulin (DS of 2.5), and 75% of glutamic diacetic acid (GLDA). All compositions were completed with water to reach 100%. With regard to the sodium hydroxide (NaOH) solution, the percentage in active ingredient was 5%. With regard to the biodegradable aminocarboxylate chelating agent (GLDA), the percentage in active ingredient was 30%. With regard to the hydrolysable dispersing polymer (carboxymethylinulin), the percentage in active ingredient was 0.5%.

Stain removal (ΔE) expected for the composition 6 (noted 6a in FIG. 2A and FIG. 2B) was calculated by adding to stain removal of composition 5 the difference between stain removal value of composition 2 and stain removal value of composition 1. The stain removal (ΔE) experimentally obtained with the composition 6 according to the present invention is noted 6*b* in FIGS. 2A and 2B.

TABLE 2

| | Comp. 1 | Comp. 2 | Comp. 5 | Comp. 6 (Expected value) | Comp. 6 (Obtained value) |
|---|---|---|---|---|---|
| Starch mix | 11.9 | 16.1 | 23.5 | 27.7 | 38.7 |
| Coffee | 35.1 | 37.9 | 48.4 | 51.2 | 59.8 |

A synergism was also observed when using the composition 6 according to the invention on starch mix or coffee stains. On starch mix, the expected stain removal (ΔE) of the composition 6 was 27.7, and a stain removal (ΔE) of 38.7 was obtained. On coffee stains, stain removal (ΔE) expected was 51.2 and stain removal (ΔE) of 59.8 was obtained.

Example 3

Tests were performed on starch mix with two different aminocarboxylate chelating agents (II) in presence of 75% of sodium hydroxide (NaOH) solution. Stain removal (ΔE) are listed in Table 3. Composition 7 contained 75% of sodium hydroxide (NaOH) solution. Composition 8 contained 75% of sodium hydroxide (NaOH) solution and 3.3% of carboxymethylinulin having a degree of substitution (DS) of 2.5. Composition 9 contained 75% of sodium hydroxide (NaOH) solution and 10% of an biodegradable aminocarboxylate chelating agent (II). Composition 10 was a composition of the present invention and contained 75% of sodium hydroxide (NaOH) solution, 3.3% of carboxymethylinulin (DS of 2.5), and 10% of biodegradable aminocarboxylate chelating agent (II). All compositions are completed with water to reach 100%. Stain removal (ΔE) expected for composition 10 (noted 10a in FIG. 3A and FIG. 3B) was calculated by adding to the stain removal (ΔE) value of composition 9 the difference between the stain removal value of composition 8 and of composition 7. The stain removal (ΔE) observed with the composition 10 according to the present invention is noted 10b in FIGS. 3A and 3B. With regard to the sodium hydroxide (NaOH) solution, the percentage in active ingredient was 37.5%. With regard to the biodegradable aminocarboxylate chelating agent (II), the percentage in active ingredient was 4%. With regard to the hydrolysable dispersing polymer (carboxymethylinulin), the percentage in active ingredient was 0.5%.

Figure 3A:
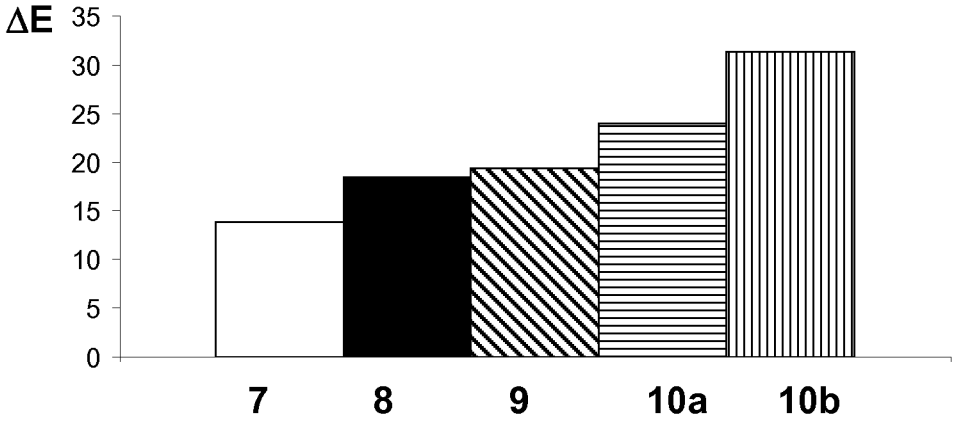
FIG. 3A and FIG. 3B are comparative charts representing stain removal (ΔE) obtained on starch mix by various compositions in presence of 75% of sodium hydroxide solution.
Figure 3B:
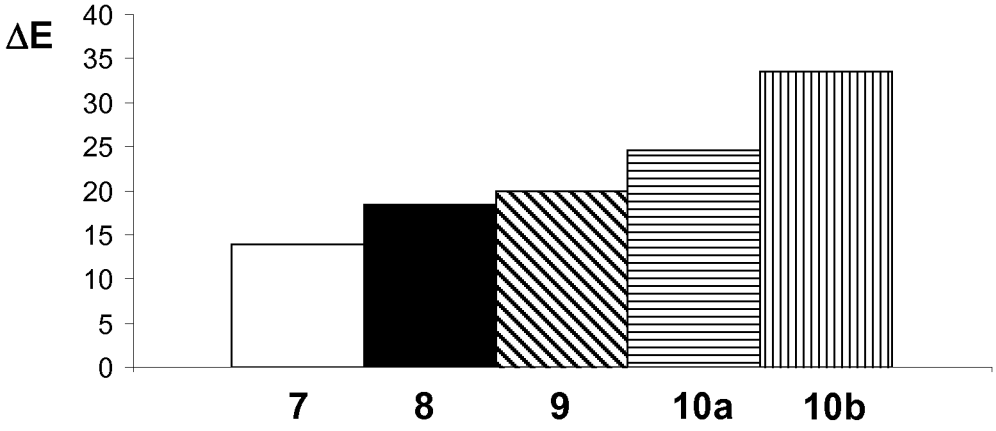

FIG. 3A reported the results when the biodegradable aminocarboxylate chelating agent was methylglycin diacetic acid (MGDA). FIG. 3B reported the results when the biodegradable aminocarboxylate chelating agent was glutamic diacetic acid (GLDA).

TABLE 3

| | Comp. 7 | Comp. 8 | Comp. 9 | Comp. 10 (Expected value) | Comp. 10 (Obtained value) |
|---|---|---|---|---|---|
| Aminocarboxylate Chelating agent (II): MGDA | 13.8 | 18.4 | 19.4 | 24.0 | 31.3 |
| Aminocarboxylate Chelating agent (II): GLDA | 13.8 | 18.4 | 19.9 | 24.5 | 33.5 |

Stain removal (ΔE) obtained with composition 10 was higher than the expected value for both biodegradable aminocarboxylate chelating agents. According to the present invention, combining a biodegradable aminocarboxylate chelating agent and a hydrolysable dispersing polymer allows an improvement in stain removal. A synergism between both components was observed in cleaning compositions of the present invention even if the percentage in active ingredient of the biodegradable aminocarboxylate chelating agent was low.

Comparative Example 4

Comparative example 4 aims to compare the performance of cleaning compositions of the present invention with a composition wherein carboxymethylinulin was replaced by polyacrylic acid. Tests were performed with GLDA or MGDA as biodegradable aminocarboxylate chelating agent. Stain removal (ΔE) are listed in table 4 and table 5. Composition 11 contained 1.1 wt % of polyacrylic acid (Mw=4500) and 10% of sodium hydroxide (NaOH) solution. Composition 12 contained 10% of sodium hydroxide (NaOH) solution, 1.1% of polyacrylic acid, and 75% of MGDA. Composition 13 contained 10% of sodium hydroxide (NaOH) solution, 1.1% of polyacrylic acid, and 75% of GLDA. With regard to the sodium hydroxide (NaOH) solution, the percentage in active ingredient was 5%. With regard to the polyacrylic acid, the percentage of active ingredient is 0.5% and is then kept constant compared to examples with carboxymethylinulin.

TABLE 4

| | Comp. 1 | Comp. 11 | Comp. 3 | Comp. 12 (Expected value) | Comp. 12 (Obtained value) |
|---|---|---|---|---|---|
| Starch mix | 11.9 | 12.4 | 23.4 | 23.9 | 23.8 |
| Coffee | 35.1 | 35.5 | 49.1 | 49.5 | 49.7 |

TABLE 5

| | Comp. 1 | Comp. 11 | Comp. 5 | Comp. 13 (Expected value) | Comp. 13 (Obtained value) |
|---|---|---|---|---|---|
| Starch mix | 11.9 | 12.4 | 23.5 | 24 | 24.1 |
| Coffee | 35.1 | 35.5 | 48.4 | 48.8 | 49.4 |

No synergy at all was observed with compositions 12 and 13 comprising polyacrylic acid instead of a hydrolysable dispersing polymer such as carboxymethylinulin. The same results were observed when the amount of NaOH was 75% and the amount of biodegradable aminocarboxylate chelating agent was 10%.

Example 5

Spotting and filming tests were performed under domestic conditions. The cleaning composition, added to the auto dishwasher, contained 45 wt % of biodegradable aminocarboxylate chelating agent (MGDA, GLDA, or IDS), 22.5 wt % of soda ash, 3 wt % of non-ionic 7E0, 7.5 wt % of Disilicate de Sodium, 7.5 wt % of perborate de sodium, 3 wt % of tetraacetyl ethylene diamine, 3 wt % of enzymes (1.5 wt % amylase and 1.5 wt % protease). The composition further comprised either carboxymethylinulin (2 wt %) or polyacrylate (3 wt %). In the cleaning composition, the active ingredient percentage was 0.3% for carboxymethylinulin and 1.2% for polyacrylate. Glasses were soiled with 50 g of ballast soil and placed into the autodishwasher. Tests were performed at 50° C. for 78 minutes. Water hardness was at 300 ppm $CaCO_3$ After the washing was completed, a panel of five peoples gave independently a quote from 0 (soil glass) to 10 (clean glass). An average quote was then calculated. The results are listed in Table 6 for the spotting tests. The control was based on a composition containing one biodegradable aminocarboxylate chelating agent (II) (either MGDA or GLDA) and without hydrolysable dispersing polymer. The same value was obtained when MGDA or GLDA was used.

TABLE 6

| | Control | MGDA + Polyacrylate | GLDA + Polyacrylate | MGDA + CMI | GLDA + CMI |
|---|---|---|---|---|---|
| Spotting quote | 6.7 | 6.3 | 7.3 | 7.5 | 8.5 |

Spotting tests showed that a composition combining a biodegradable aminocarboxylate chelating agent such as MGDA or GLDA,with carboxymethylinulin is more efficient than a composition comprising a polyacrylate and an biodegradable aminocarboxylate chelating agent. The same results were observed when iminodisuccinic acid (IDS) was used in the composition instead of MGDA or GLDA.

Filming tests evaluated the presence or not of a film on the surface of the glass. The same quotation system was used (0 when a film is strongly present to 10 when no film was observed. The results are listed in Table 7.

TABLE 7

| | Control | MGDA + Polyacrylate | GLDA + Polyacrylate | MGDA + CMI | GLDA + CMI |
|---|---|---|---|---|---|
| Filming quote | 4 | 6.3 | 6.8 | 7.5 | 7.5 |

Filming tests showed that a cleaning composition comprising a biodegradable aminocarboxylate chelating agent, such as MGDA or GLDA, in combination with a hydrolysable dispersing polymer such as carboxymethylinulin is more efficient than a cleaning composition wherein carboxymethylinulin is replaced by polyacrylate The terms and descriptions used herein are set forth by way of illustration only and are not meant as limitations. Those skilled in the art will recognize that many variations are possible within the spirit and scope of the invention as defined in the following claims, and their equivalents, in which all terms are to be understood in their broadest possible sense unless otherwise indicated. As a consequence, all modifications and alterations will occur to others upon reading and understanding the previous description of the invention. In particular, dimensions, materials, and other parameters, given in the above description may vary depending on the needs of the application.

The invention claimed is:

1. A cleaning composition, wherein the composition is an alkaline composition, having a pH higher than 9, and comprises:

(I) 0.15 to 2% in active ingredient of a hydrolysable dispersing polymer, and (II) 2 to 30% in active ingredient of one or more biodegradable aminocarboxylate chelating agents, wherein said hydrolysable dispersing polymer is selected from the group consisting of carboxylated fructan components.

2. The cleaning composition according to claim 1, wherein the said one or more biodegradable aminocarboxylate chelating agents (II) are of general formula (A), or a salt thereof:

(A)

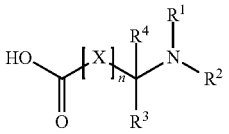

wherein $R^1$ and $R^2$ are independently selected from the group consisting of hydrogen, $C_1$-$C_{10}$ linear, branched or cyclic hydrocarbon radicals bearing one or more carboxylic acid groups and salts thereof, $R^3$ and $R^4$ are independently selected from the group consisting of hydrogen, COOH and $C_1$-$C_{10}$ linear, branched, cyclic or aromatic hydrocarbon radicals, which radicals are unsubstituted or substituted by one or more substituents, said substituents are selected from the group consisting of OH, COOH, COOR', F, Br, Cl, I, OR', $SO_3H$, $SO_3R'$, SH, SR', $NH_2$, $NR'_2$, $CONH_2$, $CONR'_2$, $C_5$-$C_6$ heterocyclic groups, $C_1$-$C_{10}$ linear, branched, cyclic or aromatic groups unsubstituted or substituted by one or more OH, COOH, COOR', F, Br, Cl, I, OR', $SO_3H$, $SO_3R'$, SH and/or SR' moieties wherein R' is a $C_1$-$C_{10}$ linear, branched, cyclic or aromatic hydrocarbon group, n is an integer from 0 to 10, and X is a substituted or unsubstituted methylene group.

3. The cleaning composition according to claim 1, wherein the said one or more biodegradable aminocarboxylate chelating agents (II) are of the general formula (A), or salt thereof:

(A)

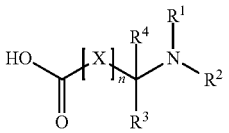

wherein $R^1$ and $R^2$ are independently selected from the group consisting of hydrogen, $C_1$-$C_3$ linear, branched or cyclic hydrocarbon radicals bearing one or more carboxylic acid groups and salts thereof, $R^3$ and $R^4$ are independently selected from the group consisting of hydrogen, COOH and $C_1$-$C_{10}$ linear, branched, cyclic or aromatic hydrocarbon radicals, which radicals are unsubstituted or substituted by one or more substituents, said substituents are selected from the group consisting of OH, COOH, COOR', F, Br, Cl, I, OR', $SO_3H$, $SO_3R'$, SH, SR', $NH_2$, $NR'_2$, $CONH_2$, $CONR'_2$, $C_5$-$C_6$ heterocyclic groups, and $C_1$-$C_{10}$ linear, branched, cyclic or aromatic groups unsubstituted or substituted by one or more OH, COOH, COOR', F, Br, Cl, I, OR', $SO_3H$, $SO_3R'$, SH and/or SR' moieties wherein R' is a $C_1$-$C_{10}$ linear, branched, cyclic or aromatic hydrocarbon group, n is an integer from 0 to 10, and X is a substituted or unsubstituted methylene group.

4. The cleaning composition according to claim 1, wherein the said one or more biodegradable aminocarboxylate chelating agents (II) are of the general formula (A), or salt thereof:

(A)

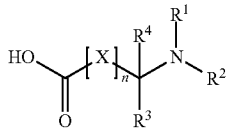

wherein $R^1$ and $R^2$ are independently selected from the group consisting of hydrogen, $C_1$-$C_3$ linear, branched or cyclic hydrocarbon radicals bearing one or more carboxylic acid groups and salts thereof, $R^3$ and $R^4$ are independently selected from the group consisting of hydrogen, COOH and $C_1$-$C_6$ linear, branched, cyclic or aromatic hydrocarbon radicals, which radicals are unsubstituted or substituted by one or more substituents, said substituents are selected from the group consisting of OH, COOH, COOR', F, Br, Cl, I, OR', $SO_3H$, $SO_3R'$, SH, SR', $NH_2$, $NR'_2$, $CONH_2$, $CONR'_2$, $C_5$-$C_6$ heterocyclic groups and $C_1$-$C_6$ linear, branched, cyclic or aromatic groups unsubstituted or substituted by one or more OH, COOH, COOR', F, Br, Cl, I, OR', $SO_3H$, $SO_3R'$, SH and/or SR' moieties wherein R' is a $C_1$-$C_6$ linear, branched, cyclic or aromatic hydrocarbon group, n is an integer from 0 to 4, and X is a substituted or unsubstituted methylene group.

5. The cleaning composition according to claim 1, wherein the said one or more biodegradable aminocarboxylate chelating agents (II) are of general formula (A), or salt thereof:

(A)

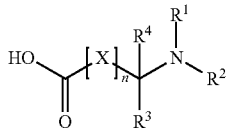

wherein $R^1$ and $R^2$ are independently selected from the group consisting of hydrogen, $C_1$-$C_3$ linear, branched or cyclic hydrocarbon radicals bearing one or more carboxylic acid groups and salts thereof, $R^3$ and $R^4$ are independently selected from the group consisting of hydrogen, COOH and $C_1$-$C_3$ linear, branched, cyclic or aromatic hydrocarbon radicals, which radicals are unsubstituted or substituted by one or more substituents, said substituents are selected from the group consisting of OH, COOH, COOR', F, Br, Cl, I, OR', $SO_3H$, $SO_3R'$, SH, SR', $NH_2$, $NR'_2$, $CONH_2$, $CONR'_2$, $C_5$-$C_6$ heterocyclic groups, and $C_1$-$C_6$ linear, branched, cyclic or aromatic groups unsubstituted or substituted by one or more OH, COOH, COOR', F, Br, Cl, I, OR', $SO_3H$, $SO_3R'$, SH and/or SR' moieties wherein R' is a $C_1$-$C_3$ linear, branched, cyclic or aromatic hydrocarbon group, n is an integer from 0 to 2, X is a substituted or unsubstituted methylene group.

6. The cleaning composition according to claim 1, wherein the said one or more biodegradable aminocarboxylate chelating agents (II) are selected from the group consisting of methylglycine diacetic acid (MGDA), glutamic diacetic acid (GLDA), iminosuccinic acid, salts thereof, and mixtures thereof.

7. The cleaning composition according to claim 1, wherein the said hydrolysable dispersing polymer (I) is a carboxylated fructan component selected from the group consisting of:

a) carboxyalkylfructan having from 1 to 4 carbon atoms in the alkyl moiety, b) dicarboxyfructan having a degree of oxidation (DO) of from 10 to 100% expressed as a molar percentage of monosaccharide units converted into the corresponding dicarboxy analogues, c) 6-carboxyfructan, d) fructan polycarboxylic acid, having a degree of carboxyalkylation or carboxyacylation of from 0.2 to 3.0, and e) mixtures thereof.

8. The cleaning composition according to claim 1, wherein the dispersing polymer (I) is carboxymethylinulin having a degree of substitution of from 1.5 to 2.7.

9. The cleaning composition according to claim 1, wherein the weight ratio of components (I) to (II) is in the range of 30:1 to 1:100.

10. A method for stain removal in institutional and industrial surfaces cleaning and/or in domestic surfaces cleaning comprises the step of contacting the surfaces with a cleaning composition according to claim 1.

11. A method for cleaning a surface comprising the step of contacting the surface with a cleaning composition according to claim 1.

* * * * *